US008216119B2

(12) United States Patent
Lamkemeyer

(10) Patent No.: US 8,216,119 B2
(45) Date of Patent: Jul. 10, 2012

(54) PAPER SACK BOTTOMING DEVICE

(75) Inventor: Andreas Lamkemeyer, Osnabrueck (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/563,859

(22) PCT Filed: Jul. 6, 2004

(86) PCT No.: PCT/EP2004/007489

§ 371 (c)(1),
(2), (4) Date: Jan. 9, 2006

(87) PCT Pub. No.: WO2005/002838

PCT Pub. Date: Jan. 13, 2005

(65) Prior Publication Data

US 2006/0160685 A1 Jul. 20, 2006

(30) Foreign Application Priority Data

Jul. 7, 2003 (DE) ..... 103 30 751

(51) Int. Cl.
*B31B 1/78* (2006.01)

(52) U.S. Cl. ..... 493/309; 493/150; 493/131

(58) Field of Classification Search ..... 493/309, 493/150, 78, 131, 208, 264, 331, 336, 124, 493/553.5, 562; 239/124, 553.5, 562
See application file for complete search history.

(56) References Cited

U.S. PATENT DOCUMENTS

| | | | | | |
|---|---|---|---|---|---|
| 3,286,689 | A | * | 11/1966 | Ziemba | 118/411 |
| 3,849,241 | A | * | 11/1974 | Butin et al. | 428/137 |
| 4,157,149 | A | | 6/1979 | Moen | |
| 4,461,236 | A | | 7/1984 | Langenbach | |
| 4,526,733 | A | * | 7/1985 | Lau | 264/12 |
| 4,687,137 | A | * | 8/1987 | Boger et al. | 239/124 |
| 5,116,448 | A | * | 5/1992 | Murayama et al. | 156/350 |
| 5,145,689 | A | * | 9/1992 | Allen et al. | 425/72.2 |
| 5,368,233 | A | * | 11/1994 | Brusko | 239/290 |
| 5,382,312 | A | * | 1/1995 | Raterman | 156/500 |
| 5,609,711 | A | * | 3/1997 | Miller | 156/292 |
| 5,728,219 | A | * | 3/1998 | Allen et al. | 118/315 |
| 6,171,427 | B1 | * | 1/2001 | Hess et al. | 156/208 |
| 6,220,843 | B1 | | 4/2001 | Allen | |
| 6,463,716 | B1 | * | 10/2002 | Focke et al. | 53/370.3 |
| 2002/0026897 | A1 | | 3/2002 | Burmester et al. | |
| 2002/0079327 | A1 | | 6/2002 | Estelle et al. | |

FOREIGN PATENT DOCUMENTS

| | | |
|---|---|---|
| DE | 1226869 | 10/1966 |
| EP | 0 081 100 | 6/1983 |

* cited by examiner

*Primary Examiner* — Sameh H. Tawfik
(74) *Attorney, Agent, or Firm* — Jacobson Holman PLLC

(57) ABSTRACT

A base insert device for forming crossed bases in paper bags has folding devices, which introduce folds in tubular sections from which the bags are produced, gluing stations, which apply glue to the regions of the folds for gluing and/or to sheets provided for gluing to the base, and a pressing station in which the folded bases and the sheets are brought into contact with one another and glued. Glue outlet openings in the gluing station are provided with an application head that supports valves which can selectively open and close a connection between the glue outlet openings and a glue supply unit. The glue supply unit has glue supply lines and at least one chamber through which at least one part of the valves is supplied with glue. The chamber has a diameter of at least 5 mm in at least one point.

20 Claims, 6 Drawing Sheets

PAPER SACK BOTTOMING DEVICE

CROSS-REFERENCE TO RELATED APPLICATION

This is a nationalization of PCT/EP04/007489 filed Jul. 6,2004 and published in German.

BACKGROUND OF THE INVENTION

1. Field of Invention

The present invention relates to a base insert device for the production of paper bags. The device has folding devices, which make folds at the ends of tube sections from which the bags are produced, one or more gluing stations, which provide glue to the areas of the folds to be glued and/or labels provided with the bottom for gluing, and at least one press compaction deck, in which the folded bottoms and the labels are contacted with each other and glued.

2. Description of the Prior Art

Devices of this type are used in the production of various types of bags. These bags include, for example, the so-called valve bags in which valve patches are usually inserted when manufacturing the bases of the bags. The bases are frequently designed as crossed bases as illustrated, for example in the patent applications DE 090 145 48 U1and DE 3020043 A1. In order to provide the bases and the inserted valve patches with a lasting cohesion, parts of the bases are stuck one below the other and/or to the valve patches with the help of glue.

For this purpose, glue is applied to either the regions of the base folds to be glued or the sheets provided to them, thus all the regions that are to be glued to one another and these are subsequently glued to one another by merging them or folding them together.

A format-specific glue application usually takes place in the following manner: A format part attached on a rotating roller is brought into contact during the rotation of said roller with a glue roller or with other glue storing components or transfer components and is thus supplied with glue. In the further course of the rotation of the roller, the format plate transfers the glue stored on it onto each region of the subsequently formed bases of the bags or the sheets to be glued. For this purpose, the format part is provided with characteristic ridges that are adapted to a definite bag format. The format parts are replaced for producing bags having other formats on the base insert device. This type of glue application has stood the test of time since it enables the clean and format-specific application of large quantities of starch glue, which is otherwise difficult to handle.

The words "format-specific glue application" refers to a form of application that is adapted to the type and the format of the bag. In this form of application, the glue is usually applied in a flat manner, whereby special significance is accorded to the edges of the form for the durability and the impermeability of the bags.

However, the disadvantage is that this method of glue transfer makes it necessary to provide and subsequently clean a plurality of glue transfer components, for instance the format rollers and the format parts.

SUMMARY OF THE INVENTION

Therefore the object of the present invention is to further improve the design of the base insert device in such a way that these glue transfer components can be totally omitted while still enabling a format-specific application of the glue, whereby the glue must be distributed evenly over the surface to be glued.

The aforementioned object is achieved by the characterizing features of the invention as described herein.

Thus, at least one gluing station is provided in the base insert device, which

- comprises glue outlet openings which may be selectively supplied with glue, whereby the selection of the glue outlet openings defines the format of the glue application (6, 7, 8, 9),
- whereby said glue outlet openings are provided with at least one application head (1)
- which supports valves (3) that can selectively open and close the connection between glue outlet openings and a glue supply unit (4a, 4b, 13, 15),
- whereby said glue supply unit comprises glue supplying lines (4a, 4b, 13) and at least one chamber (15) through which at least one part of the valves (3) is supplied with glue and which has a diameter of at least 5 mm at least in one point.

The application head can be provided with an application plate into which said glue outlet openings that can be selectively supplied with glue, are inserted. In order to enable glue discharge when the valves are opened, the glue is exposed to a pressure that is greater than the ambient pressure. The valves are initially supplied with glue using glue supplying lines, which supply the glue to a chamber. The valves are in contact with this chamber. By providing the valves with a diameter of m mm, it can be ensured that the extremely viscous glue, usually starch glue, can flow through the chamber without clogging the chamber. The chamber can have a circular cross-section. However, the cross-section can also have a shape that differs from a circular shape. However, the cross-section must be dimensioned in such a way that a circle having a diameter of 5 mm can be inscribed so as to ensure a continuous flow of glue to all the valves.

The chamber preferably has a diameter of at least 7 mm. Only in the case of a diameter of 7 mm is it possible to ensure that essentially the same glue pressure is prevalent at all the valves. If this diameter is fallen short of, it is possible that the rear valves in the flow direction of the glue are only supplied with a low glue pressure. Consequently, the glue traces generated from these valves also can be too thin.

However, in a preferred embodiment of the present invention, the chamber has a diameter of at least 10 mm. This diameter is provided particularly if the valves are arranged very densely.

In another preferred embodiment of the present invention, the chamber is arranged in the application head or directly on the application head in order to maintain a small distance between the chamber and the valves. If pressure is applied to the glue, which as described already, can be very viscous, then the pressure rests against the valve without any substantial pressure losses when the connections from the chamber to the valve are short. This connection is usually a few millimeters long.

In another embodiment of the present invention, at least two valves are arranged such that they overlap in the spatial direction (y) perpendicular to the feed direction (x) of the bag components. The valves are supplied with glue from the same chamber. This makes it possible to achieve a denser arrangement of the valves in the spatial direction (y) and thus a greater density of glue traces, which can be applied or interrupted independently of one another. Such an arrangement of the valves comprises, in particular, a two-row or multi-row arrangement whereby the rows run the spatial direction (y)

and are interspaced in the feed direction (x) of the bag components. Spatial direction (y) refers to that direction, which extends perpendicular to the feed direction (x) of the bag components, but lies in the plane that is determined by the bag components. The third spatial direction, which indeed extends perpendicular to the feed direction (x) of the bag components, however also perpendicular to the plane of the bag components, plays no role in the context of the present invention.

Furthermore, it is particularly advantageous if the volume of the chamber has a ratio of at least 1:5 to the volume sum of all the glue connections to and from the valves, which are supplied with glue from this chamber. The pressure prevailing in the chamber also rests against all the valves without any substantial pressure losses only by ensuring the existence of this factor by which the volume of the chamber is greater than the sum of the glue supplying lines. Thus it is ensured that when the valves are opened, the glue is pressed out with essentially the same pressure from all the glue outlet openings, which are supplied with glue via the chamber.

In another preferred embodiment of the present invention, the chamber is a borehole that is inserted into the application head. The application head can be provided on both its front ends with a first borehole, through which the glue is supplied to the cavity, and a second borehole, through which the glue is redischarged. The cross-sectional areas of these inlet holes and outlet holes are smaller than the cross-section of the chamber. In a preferred embodiment, the cross-section of the chamber is greater than the cross-section of the glue supplying lines by 40 $mm^2$. However, the glue supply can also be implemented by a tube that engages into the application head or a tube that penetrates through the application head. In order to enable the glue to arrive into the cavity of the application head, the tube has boreholes or openings in the region of the application head. In this arrangement, the application head can also be arranged such that it can be displaced on the tube.

Additional advantageous embodiments of the present invention are specified in the graphic description, the drawings and the remaining claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
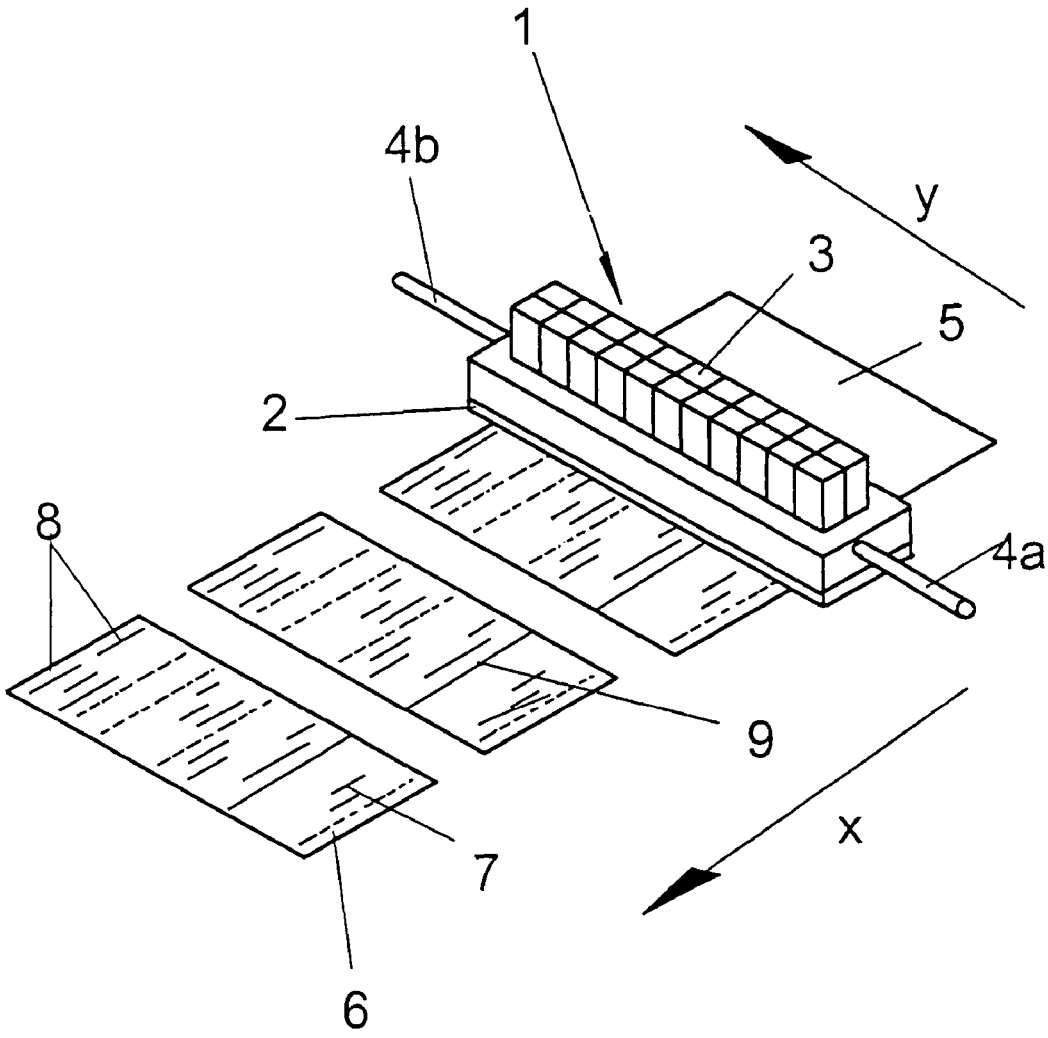
FIG. 1 an individual application head provided for the gluing station in the base insert device according to the present invention FIG. 2 an arrangement having several application heads FIG. 3 frontal view of an application head

FIG. 1 illustrates an application head 1, as is used in a gluing station in the base insert device according to the present invention. This application head 1 is composed of an application plate 2, to which valves 3 are attached. The glue is supplied to the application head 1 via the glue supplying line 4*a*. The glue arrives out of the application head via the glue supplying line 4*b*. Unglued sheets 5 are supplied to the gluing station in direction x.

Every valve 3 is provided with one glue outlet opening or a group of glue outlet openings in the side of the application plate 2 that is turned towards the unglued sheets 5. The glue flow to the glue outlet opening can be produced or interrupted by the assigned valve 3. In this manner it is possible to apply on the unglued sheets 5 different glue traces that run parallel to the feed direction x of the unglued sheets 5. By regularly opening and closing the valve 3, a regularly interrupted glue trace 5 [sic; 6] can be applied. Likewise, it is possible to produce short glue traces 7 or interrupted glue traces 8 and continuous glue traces 9. If no unglued sheet 5 is located below the application head 1, then all the valves 3 interrupt the glue flow so that the gluing station is not contaminated unnecessarily. In order to be able to glue all the regions of the unglued sheets in the direction y perpendicular to the feed direction, the application head 1 can also be displaced in this direction. However, the application head just described above can be used not only for gluing sheets, but is also suitable for applying glue on the regions of the subsequently formed bases of the bags to be glued due to the variability of the glue traces that can be produced.

Figure 2:
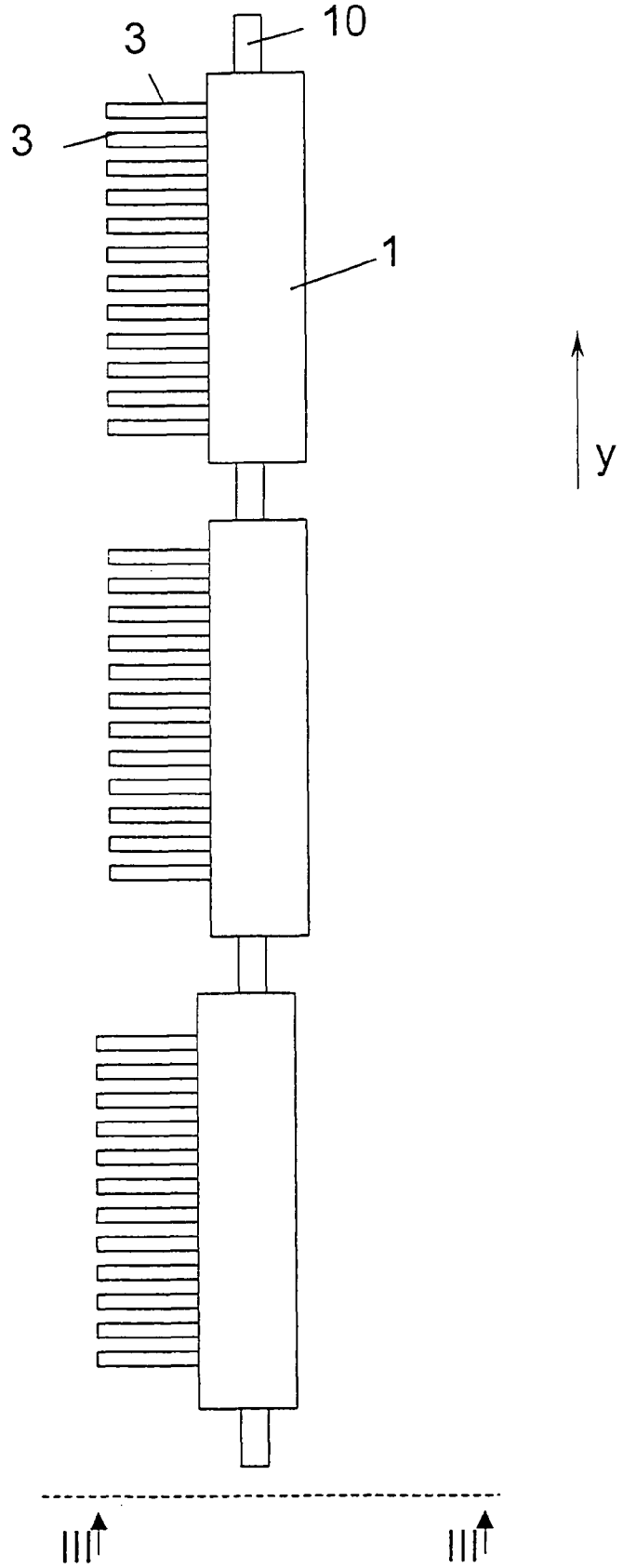

FIG. 2 illustrates a linear arrangement of several application heads 1, which are arranged along the tube 10 in the direction y perpendicular to the feed direction x. The tube 10 can also serve as a guide rail, along which the individual application heads 1 can be displaced relative to one another. Rows of valves 3 are attached to each of the application heads 1.

Figure 3:
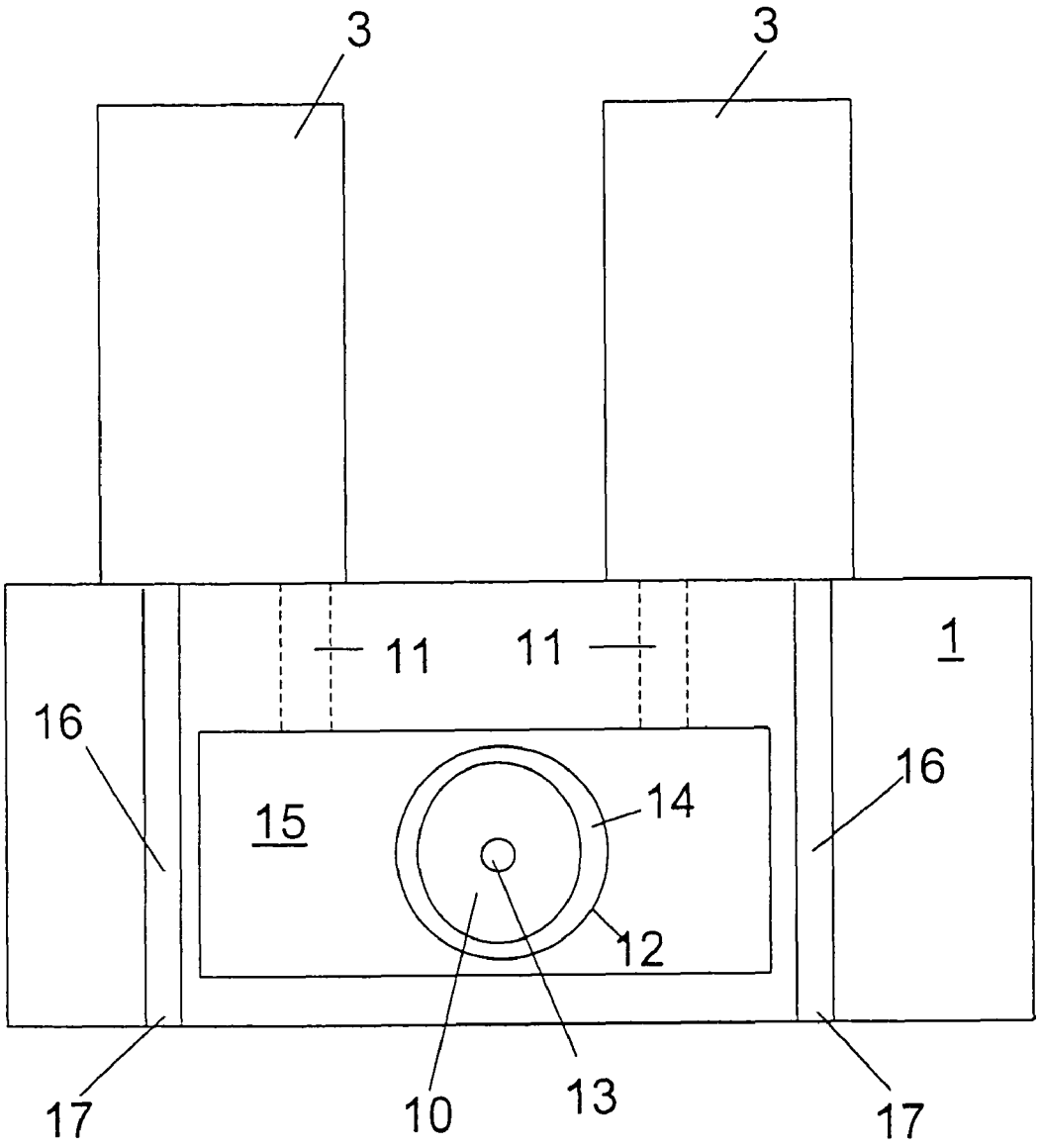

FIG. 3 illustrates a frontal view of an application head 1 according to the section III-III from FIG. 2. The application head 1 is equipped with two parallel rows of valves 3, whereby the valves 3 can also be arranged such that they can be displaced in the direction y (not visible). In order to be able to supply these valves 3 with glue, glue connections 11 to the valves 3 are inserted into the application head 1. Said glue connections begin in the chamber 15. The chamber 15 is supplied with glue by the glue supplying line 13 and by boreholes (not visible) in the tube 10 that connect the glue supplying line 13 to the chamber 15. In order to be able to seal the chamber 15 from the exterior of the application head 1, a sealing 14 that clasps around the tube 10 is inserted into the front-sided borehole 12. In order to let the glue reach the glue outlet openings 17 from the valves 3, the application head has an additional glue connection 16.

Figure 4A:
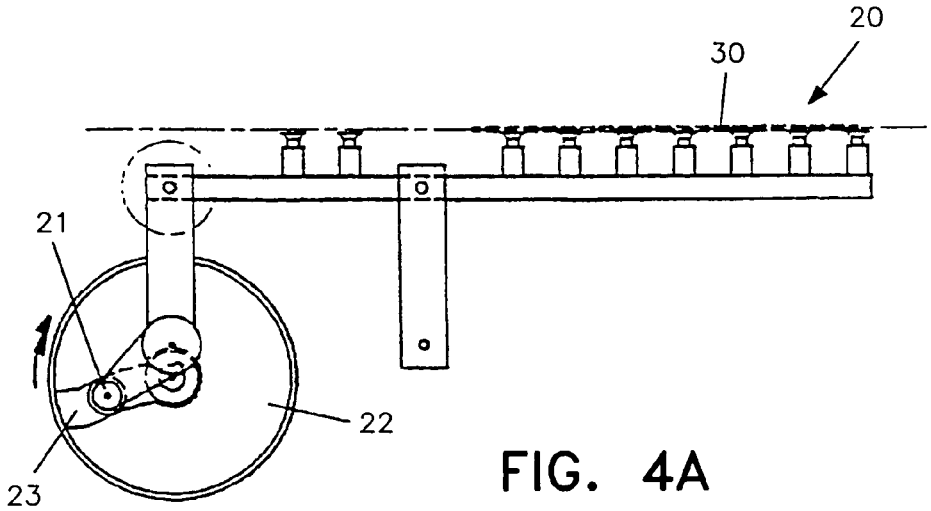
FIG. 4A is a schematic side view of a folding device of the present invention and shows a tube section in a flat, unopened position on the device.
Figure 4B:
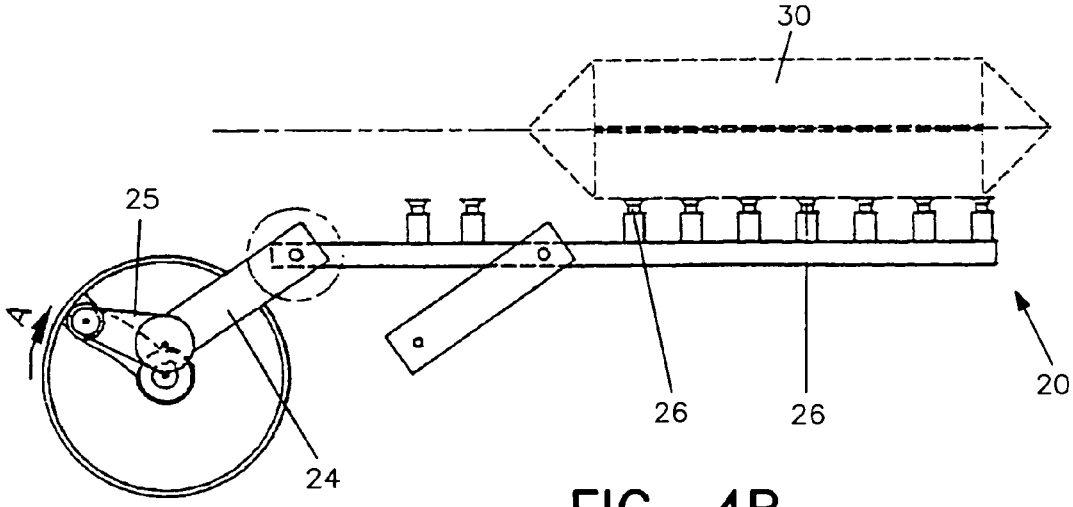
FIG. 4B is another schematic side view of the folding device shown in FIG. 4A and shows the tube section in an opened position.

FIG. 4A is a schematic side view of a folding device 20 of the present invention and shows a tube section 30 in a flat, unopened position on the device. FIG. 4B is another schematic side view of the folding device 20 shown in FIG. 4A and shows the tube section in an opened position. The folding device 20 has a roll 21, a disk 22, a guide 23, a connecting rod 24, a crank 25, and a plurality of suction units 26.

Figure 5:
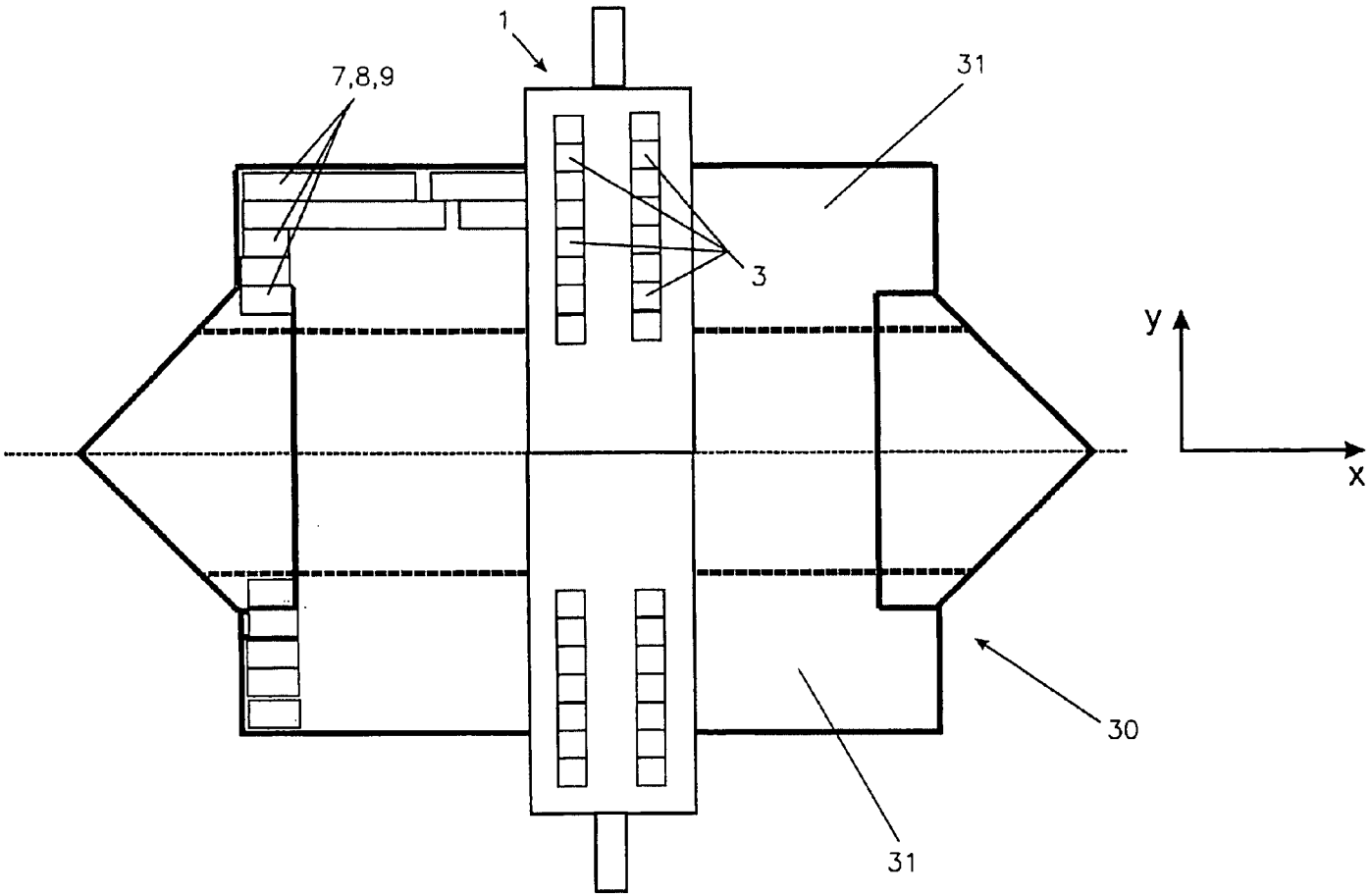
FIG. 5 is a schematic plan view of a glue application head and associated valves in accordance with the present invention.

FIG. 5 is a schematic plan view of the above-described glue application head 1 and the associated valves 3 in accordance with the present invention. By triggering (i.e., opening) the valves 3, the various glue traces 7, 8, 9 can be applied to the tube section (i.e., opened sack bottom) 30.

Figure 6:
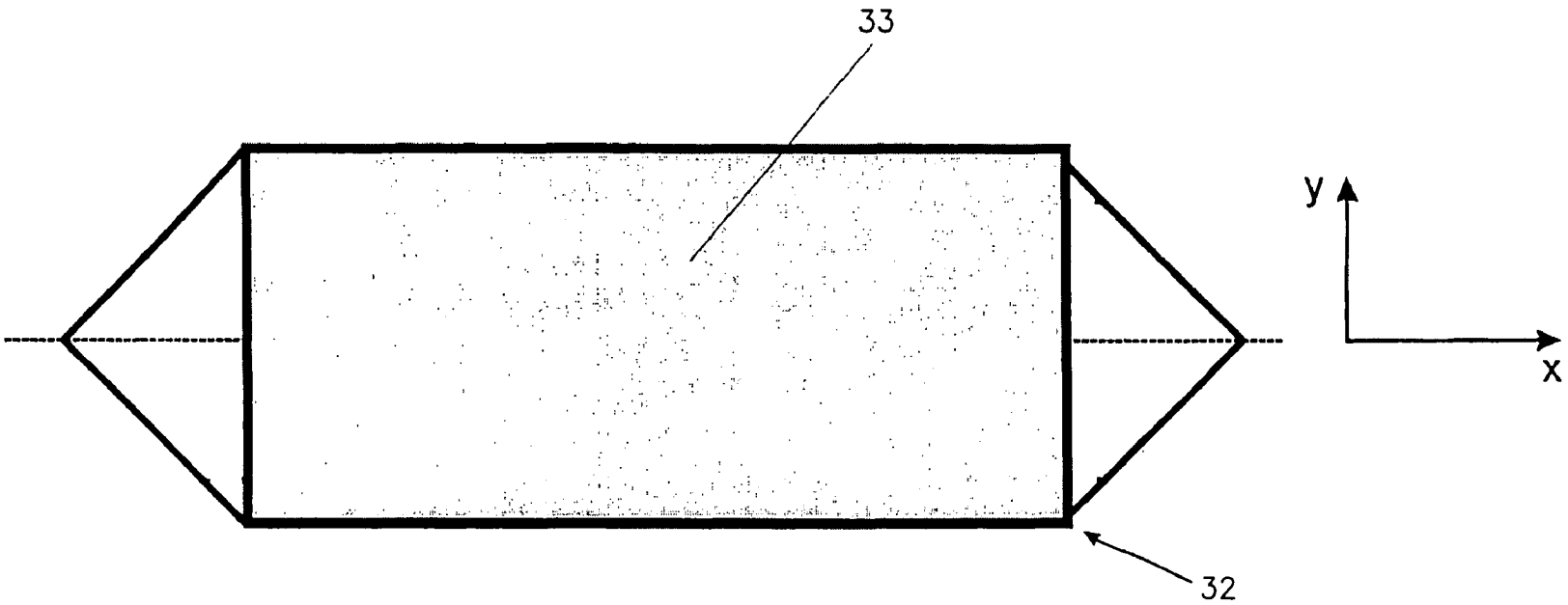
FIG. 6 is a schematic plan view of a glued and folded sack bottom formed in accordance with the present invention.

FIG. 6 is a schematic plan view of a glued and folded sack bottom formed in accordance with the present invention. After the opened sack bottom 30 is provided with the glue traces 7, 8, 9, the side gussets 31 (see FIG. 5) are folded onto the opened sack bottom 30. Then, the closed sack bottom 32 can be provided with a label 33. Before the label 33 is put onto the closed sack bottom 32, the label 33 is provided with glue.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of Reference Symbols

| | |
|---|---|
| 1 | Application head |
| 2 | Application plate |
| 3 | Valve |
| 4a, 4b | Glue supplying line |
| 5 | Unglued sheet |
| 6 | Regularly interrupted glue trace |
| 7 | Short glue trace |
| 8 | Interrupted glue trace |
| 9 | Continuous glue trace |
| 10 | Tube |
| 11 | Glue connection to the valve 3 |
| 12 | Front-sided borehole |
| 13 | Glue supplying line |
| 14 | Sealing |
| 15 | Chamber |
| 16 | Glue connection |
| 17 | Glue outlet opening |
| x | Feed direction of the sheets |
| y | Direction perpendicular to the feed direction x of the sheets |

What is claimed is:

1. A base insert device for making cross bottoms on cross bottom valve paper bags, comprising:

folding devices that make folds at ends of tube sections from which the bags are produced to make a folded bottom;

one or more gluing stations configured to apply a starch glue to at least one of areas of the folds to be glued and labels provided with the bottom for gluing, the gluing stations including glue outlets which can be fed selectively such that a format of the applied glue is defined by selection of the glue outlets, and at least one application head to which the glue outlets are assigned; and at least one press compaction deck in which the folded bottoms and the labels are brought into contact with each other and glued, the application head having mounted thereon a valve which can selectively open and shut a connection between the glue outlets and a glue feed, and the glue feed including (i) at least one chamber through which at least one part of the valves is fed with the glue and which has a diameter of at least 5 mm in at least one place, and (ii) at least one glue supplying line which extends to the application head, the glue supplying line engaging into the chamber and the application head mounted to displace along the glue supplying line in a direction y extending perpendicular to a transport direction x of the bag and in a plane parallel to a plane in which the bag lies during transport so as to enable the glue outlets to apply the glue to all regions in the y direction of the areas to be glued.

2. The base insert device according to claim 1 wherein the chamber has a diameter of at least 7 mm.

3. The base insert device according to claim 2 wherein the chamber has a diameter of at least 10 mm.

4. The base insert device according to claim 3 wherein the chamber has a diameter of at least 15 mm.

5. The base insert device according to claim 1 wherein the chamber is provided in the application head or directly on the application head.

6. The base insert device according to claim 1 wherein the chamber extends linearly in a spatial direction perpendicular to the transport direction of the bag.

7. The base insert device according to claim 1 wherein at least two of the valves which are supplied with the glue from the chamber are arranged in an overlapping manner relative to a spatial direction that extends perpendicular to the transport direction of the bag.

8. The base insert device according to claim 1 wherein a sum of dimensions of the valves in the spatial direction y perpendicular to the bag transport direction x is larger than a length of the chamber in the spatial direction y, with all of the valves being supplied with the glue from the chamber.

9. The base insert device according to claim 1 wherein a volume of the chamber has a ratio of at least 1.5 to a volume sum of all of the glue connections to and from the valves which are supplied with the glue from the chamber.

10. The base insert device according to claim 1 wherein the gluing station includes a plurality of chambers such that every chamber supplies one part of the valves in each case with the glue.

11. The base insert device according to claim 1 wherein the chamber has a rectangular cross-section.

12. The base insert device according to claim 1 wherein the chamber has a circular cross-section.

13. The base insert device according to claim 1 wherein the chamber is a borehole that is inserted into the application head.

14. The base insert device according to claim 1 wherein the glue supplying line has a cross-sectional area which is smaller than a cross-sectional area of the chamber.

15. The base insert device according to claim 14 wherein the glue supplying line cross-sectional area is smaller than the chamber cross-sectional area by at least 40 $mm^2$.

16. A base insert device for making cross bottoms on cross bottom valve paper bags, comprising:

folding devices that make folds at ends of tube sections from which the bags are produced to make a folded bottom;

one or more gluing stations configured to apply a starch glue to at least one of areas of the folds to be glued and labels provided with the bottom for gluing, the gluing stations including glue outlets which can be fed selectively such that a format of the applied glue is defined by selection of the glue outlets, and a plurality of application heads to which the glue outlets are assigned; and at least one press compaction deck in which the folded bottoms and the labels are brought into contact with each other and glued, the application heads having mounted thereon a valve which can selectively open and shut a connection between the glue outlets and a glue feed, and the glue feed including (i) at least one chamber through which at least one part of the valves is fed with the glue and which has a diameter of at least 5 mm in at least one place, and (ii) at least one glue supplying line which engages into the chamber and extends through the application heads, the application heads being movable relative to each other along the glue supplying line in a direction y that is perpendicular to a transport direction x of the bag and in a plane that is parallel to a plane in which the bag lies during transport so as to enable the glue outlets to apply the glue to all regions in the y direction of the areas to be glued.

17. The base insert device according to claim 16, wherein the glue supplying line includes boreholes or openings in a region of each of the application heads.

18. The base insert device according to claim 16, wherein the chamber is a borehole that is provided in each of the application heads.

19. The base insert device according to claim 16, wherein the chamber is provided in each of the application heads or directly on each of the application heads.

20. The base insert device according to claim 16, wherein the chamber extends linearly in a spatial direction perpendicular to the transport direction of the bag.

* * * * *